US006652914B1

(12) United States Patent
Langley et al.

(10) Patent No.: US 6,652,914 B1
(45) Date of Patent: Nov. 25, 2003

(54) METHOD FOR SELECTIVE SURFACE PROTECTION OF A GAS TURBINE BLADE WHICH HAS PREVIOUSLY BEEN IN SERVICE

(75) Inventors: Nigel Brian Thomas Langley, Danvers, MA (US); Keng Nam Chen, Singapore (SG); Genfa Hu, Singapore (SG); Kwok Heng Yow, Singapore (SG)

(73) Assignee: General Electric Aviation Service Operation Pte. Ltd. (SG)

( * ) Notice: Subject to any disclaimer, the term of this patent is extended or adjusted under 35 U.S.C. 154(b) by 0 days.

(21) Appl. No.: 10/259,343

(22) Filed: Sep. 27, 2002

(51) Int. Cl.[7] ..... B05D 3/02; B05D 3/04; B05D 1/36; C25D 5/02; C25D 5/50

(52) U.S. Cl. ..... 427/376.8; 427/250; 427/318; 427/405; 205/118; 205/228; 205/170; 205/208; 205/210; 205/216; 205/184; 205/191

(58) Field of Search ..... 205/118, 228, 205/170, 208, 210, 216, 184, 191; 427/250, 318, 376.8, 405

(56) References Cited

U.S. PATENT DOCUMENTS

| | | | | |
|---|---|---|---|---|
| 5,824,205 | A | 10/1998 | Foster | 205/109 |
| 6,270,318 | B1 | 8/2001 | Shah et al. | 416/193 |
| 6,283,715 | B1 | 9/2001 | Nagaraj et al. | 416/241 R |
| 6,296,447 | B1 | 10/2001 | Rigney et al. | 416/241 R |

*Primary Examiner*—Edna Wong
(74) *Attorney, Agent, or Firm*—Gergory Garmong; Carmen Santa Maria; McNees Wallace & Nurick LLC

(57) ABSTRACT

A gas turbine blade which has previously been in service is protected by cleaning the gas turbine blade, and then first depositing a platinum first layer on the airfoil and the platform of the gas turbine blade. Thereafter, a platinum second layer is deposited over the platform but not the airfoil. A platinum-aluminide protective coating is formed by depositing an aluminum-containing layer overlying both the platform and the airfoil and interdiffusing the platinum and the aluminum.

22 Claims, 2 Drawing Sheets

METHOD FOR SELECTIVE SURFACE PROTECTION OF A GAS TURBINE BLADE WHICH HAS PREVIOUSLY BEEN IN SERVICE

This invention relates to the gas turbine blades used in gas turbine engines and, more particularly, to selectively protecting portions of the gas turbine blades with a protective coating.

BACKGROUND OF THE INVENTION

In an aircraft gas turbine (jet) engine, air is drawn into the front of the engine, compressed by a shaft-mounted compressor, and mixed with fuel. The mixture is burned, and the hot combustion gases are passed through a turbine mounted on the same shaft. The flow of combustion gas turns the turbine by impingement against an airfoil section of the turbine blades and vanes, which turns the shaft and provides power to the compressor. The hot exhaust gases flow from the back of the engine, driving it and the aircraft forward.

The hotter the combustion and exhaust gases, the more efficient is the operation of the jet engine. There is thus an incentive to raise the combustion and exhaust gas temperatures. The maximum temperature of the combustion gases is normally limited by the materials used to fabricate the hot-section components of the engine. These components include the turbine vanes and turbine blades of the gas turbine, upon which the hot combustion gases directly impinge. In current engines, the turbine vanes and blades are made of nickel-based superalloys, and can operate at temperatures of up to about 1800–2100° F. These components are subject to damage by oxidation and corrosive agents.

Many approaches have been used to increase the operating temperature limits and service lives of the turbine blades and vanes to their current levels, while achieving acceptable oxidation and corrosion resistance. The composition and processing of the base materials themselves have been improved. Cooling techniques are used, as for example by providing the component with internal cooling passages through which cooling air is flowed.

In another approach used to protect the hot-section components, a portion of the surfaces of the turbine blades is coated with a protective coating. One type of protective coating includes an aluminum-containing protective coating deposited upon the substrate material to be protected. The exposed surface of the aluminum-containing protective coating oxidizes to produce an aluminum oxide protective layer that protects the underlying surface.

Different portions of the gas turbine blade require different types and thicknesses of protective coatings, and some portions require that there be no coating thereon. The application of the different types and thicknesses of protective coatings in some regions, and the prevention of coating deposition in other regions, while using the most cost-efficient coating techniques, can pose difficult problems for gas turbine blades which have previously been in service and are undergoing repair. In many cases, it is difficult to achieve the desired combination of protective coatings and bare surfaces. There is a need for an improved approach to such coating processes to achieve the required selectivity in the presence and thickness of the protective coating in some regions, and to ensure its absence in other regions. The present invention fulfills this need, and further provides related advantages.

BRIEF SUMMARY OF THE INVENTION

The present approach provides a technique for selectively protecting a gas turbine blade which has previously been in service, and is undergoing refurbishment and/or repair. In one application, the protective coating on the airfoil is rejuvenated, while the underside of the platform of the gas turbine blade is given a platinum aluminide coating. The present approach is cost effective, and is usable even with relatively small gas turbine blades.

A method for protecting a gas turbine blade which has previously been in service includes the step of providing the gas turbine blade which has previously been in service. The gas turbine blade has an airfoil, a dovetail, and a platform therebetween having a top surface and a bottom surface. In a usual case, the gas turbine blade has no protective coating on the bottom surface of the platform.

The gas turbine blade is first cleaned. The step of cleaning may include the steps of removing surface dirt, oxides, and corrosion products from the airfoil, and removing surface dirt, oxides, and corrosion products from the platform. Such cleaning may be accomplished by contacting the turbine blade to a weak acid bath, and thereafter grit blasting the turbine blade. In the cleaning, it is preferred that the existing coatings on the airfoil not be removed.

A precious-metal first layer is first deposited on at least an airfoil first-layer region of the airfoil to form an airfoil portion of the first layer, and at least a platform first-layer region of the platform to form a platform portion of the first layer. The precious metal of the first layer may comprise, for example, platinum, palladium, or rhodium, or alloys thereof, but is preferably platinum. The first deposition step is preferably accomplished by electrodeposition. The first deposition step usually includes first masking any surfaces that are not to have the precious-metal first layer deposited thereon. The precious-metal first layer is preferably first deposited to a thickness of from about 0.00008 to about 0.000125 inches.

A precious metal second layer is second deposited overlying at least part of the platform portion of the first layer to form a platform portion of the second layer, but not overlying the airfoil portion of the first layer. The precious metal of the second layer may comprise, for example, platinum, palladium, or rhodium, or alloys thereof, but is preferably platinum. The second deposition step is preferably accomplished by electrodeposition. The second deposition step usually includes the second masking of surfaces that are not to have the precious-metal second layer deposited thereon. The precious metal second layer is preferably deposited so that a total thickness of the precious-metal first layer and the precious-metal second layer is from about 0.00018 to about 0.00032 inches.

An aluminum-containing layer is third deposited, preferably by vapor phase deposition, overlying at least the airfoil portion of the first layer and the platform portion of the second layer. The gas turbine blade is heated to interdiffuse the aluminum and the precious metal, preferably at least in part concurrently with the third deposition step. An airfoil precious-metal aluminide coating thickness on the airfoil at a conclusion of the step of heating is about 0.001 inch greater than an airfoil precious-metal aluminide coating thickness at a conclusion of the step of cleaning. A platform precious-metal aluminide coating thickness on the platform at a conclusion of the step of heating is about 0.0025 inch greater than a platform precious-metal aluminide coating thickness at a conclusion of the step of cleaning (which is usually zero).

Stated alternatively, a method for protecting a gas turbine blade which has previously been in service comprises the steps of providing the gas turbine blade which has previously been in service, the gas turbine blade having an airfoil, a dovetail, and a platform therebetween having a top surface and a bottom surface, and cleaning the gas turbine blade. The method further includes depositing a precious-metal first layer on an airfoil first-layer region of the airfoil, depositing a precious metal second layer on at least part of the platform, wherein the precious-metal second layer is thicker than the precious-metal first layer, depositing an aluminum-containing layer overlying at least the precious-metal first layer and the precious-metal second layer, and heating the gas turbine blade to interdiffuse the aluminum and the precious metal.

The conventional practice has been not to coat the bottom surface or underside (i.e., the surface adjacent to the dovetail and remote from the airfoil) of the platform. The present approach not only refurbishes and rejuvenates the airfoil by adding a new platinum aluminide protective coating, but also provides a first-time platinum aluminide protective coating to the bottom surface of the platform (if there has not previously been a platinum aluminide protective coating on the bottom surface) or thickens an existing platinum aluminide protective coating on the bottom surface of the platform. The platinum aluminide protective coating added to the airfoil is thinner and with less platinum than the platinum aluminide protective coating on the bottom surface of the platform, due to the two-step platinum-deposition procedure. At the same time, the dovetail surfaces remain uncoated, a requirement for mating with the turbine disk.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
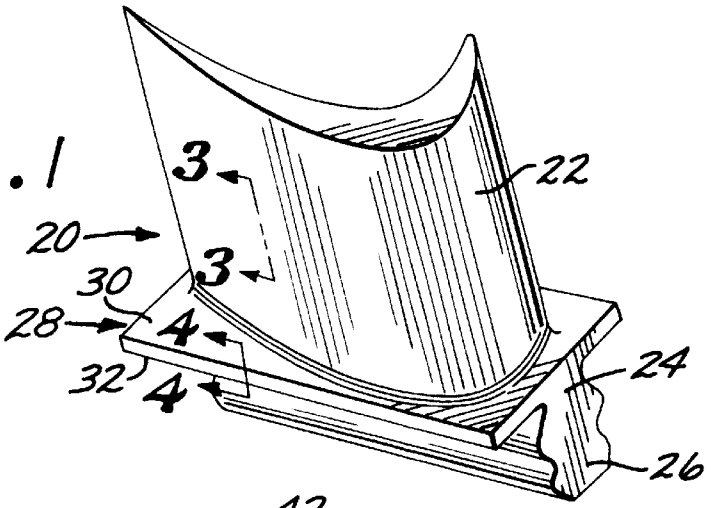
FIG. 1 is perspective view of a gas turbine blade.

FIG. 1 depicts a gas turbine blade 20 which has previously been in service. The gas turbine blade 20 has an airfoil 22 against which the flow of hot combustion gas impinges during service operation, a downwardly extending shank 24, and an attachment in the form of a dovetail 26 which attaches the gas turbine blade 20 to a gas turbine disk (not shown) of the gas turbine engine. A platform 28 extends transversely outwardly at a location between the airfoil 22, on the one hand, and the shank 24 and dovetail 26, on the other hand. The platform 28 has a top surface 30 adjacent to the airfoil 22, and a bottom surface 32 (sometimes termed an "underside" of the platform) adjacent to the shank 24 and the dovetail 26. An example of such a gas turbine blade 20 is a CF34-3B1 Stage 1 high pressure turbine blade.

The entire gas turbine blade 20 is preferably made of a nickel-base superalloy. A nickel-base alloy has more nickel than any other element, and a nickel-base superalloy is a nickel-base alloy that is strengthened by gamma-prime phase or a related phase. An example of a nickel-base superalloy with which the present invention may be used is Rene$^R$ 142, having a nominal composition in weight percent of about 12.0 percent cobalt, about 6.8 percent chromium, about 1.5 percent molybdenum, about 4.9 percent tungsten, about 2.8 percent rhenium, about 6.35 percent tantalum, about 6.15 percent aluminum, about 1.5 percent hafnium, about 0.12 percent carbon, about 0.015 percent boron, balance nickel and minor elements, but the use of the invention is not so limited.

The gas turbine blade 20, which has previously been in service, was manufactured as a new-make gas turbine blade, and then used in aircraft-engine service at least once. During service, the gas turbine blade 20 is subjected to conditions which degrade its structure. Portions of the gas turbine blade are burned away, eroded, oxidized, and/or corroded, so that its shape and dimensions change, and coatings are pitted or burned. Because the gas turbine blade 20 is an expensive article, it is preferred that relatively minor damage be repaired, rather than scrapping the gas turbine blade 20. The present approach is provided to repair, refurbish, and rejuvenate the gas turbine blade 20 so that it may be returned to service. Such repair, refurbishment, and rejuvenation is an important function which improves the economic viability of aircraft gas turbine engines by returning otherwise-unusable gas turbine blades to subsequent service after appropriate processing.

One aspect of the repair in some cases is to apply a protective coating to the bottom surface 32 of the platform 28 for the first time. Because the bottom surface 32 of the platform 28 is relatively isolated from the flow of hot combustion gas that impinges against the airfoil 22, it has been customary in the past that it not be provided with a protective coating. However, as other properties of the gas turbine blade 20 have been improved to allow ever-hotter operating temperatures for increased engine efficiency, it has become apparent that the bottom surface 32 of advanced engines may require a coating on the bottom surface 32 to inhibit and desirably avoid damage from oxidation and corrosion. The present approach is primarily addressed to the circumstance where it becomes apparent that such a protective coating is required on the bottom surface 32 of the platform 28 only after it has been in service.

Figure 2:
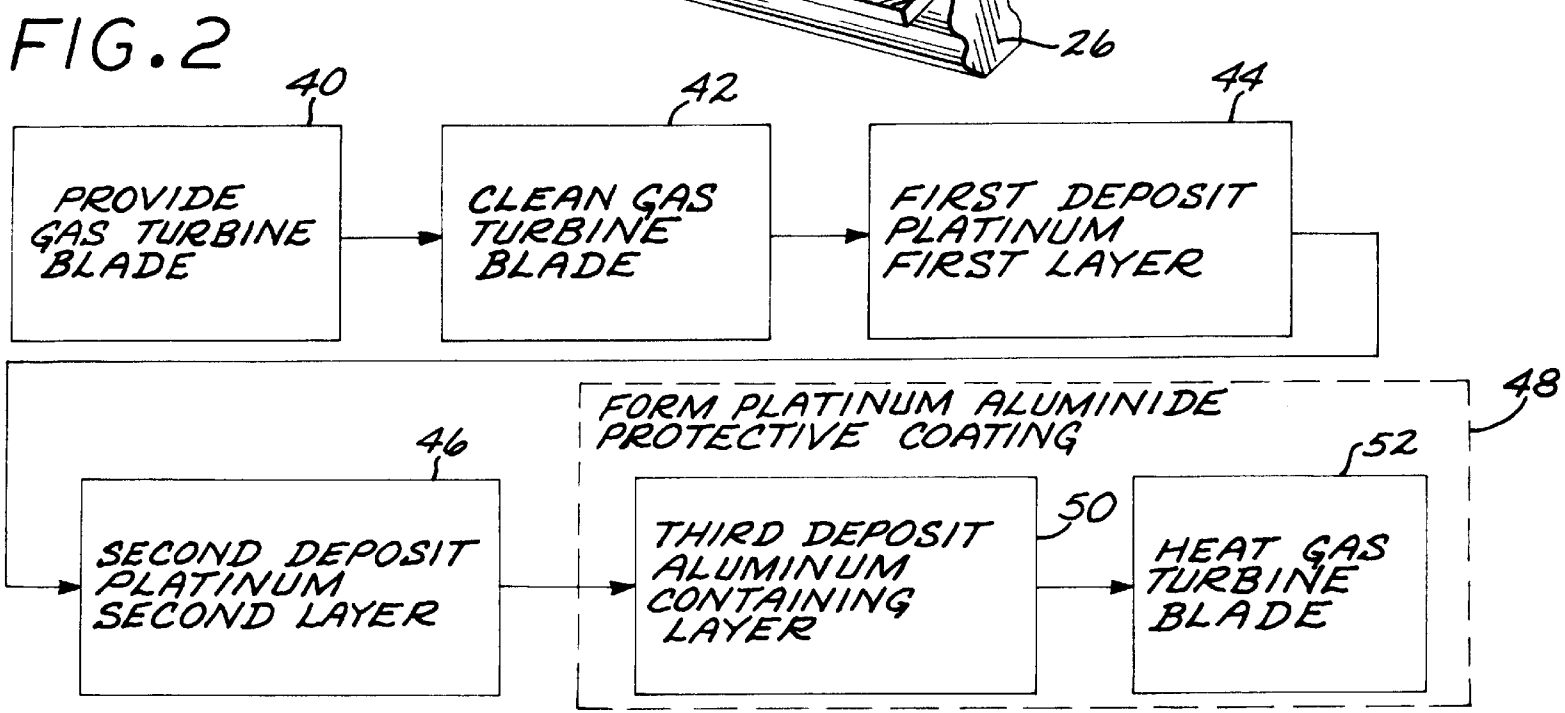
FIG. 2 is a block diagram of a method for protecting the gas turbine blade.

FIG. 2 illustrates a preferred approach for protecting such a gas turbine blade 20 which has previously been in service and requires both rejuvenation of the protective coating that is present on the airfoil 22 and also the addition of a protective coating to the platform 28. The gas turbine blade 20, such as described above, is provided, step 40. In the case described here, at least some of the surfaces of the airfoil 22 of the as-provided gas turbine blade 20 are coated with a protective coating such as a platinum aluminide coating of the type known in the art. The bottom surface 32, on the other hand, usually initially has no protective coating thereon, and therefore it presents bare metal which has been oxidized and/or corroded to some extent.

The gas turbine blade 20 is first cleaned, step 42. The cleaning normally involves the removal of surface dirt, soot, oxides, and corrosion products from the coated surface of the airfoil 22 and from the bare metal of the bottom surface 32 of the platform 28, although the nature and extent of the dirt, soot, oxides and corrosion products may vary according to the location on the gas turbine blade 20. In this case, the respective dirt, oxides, and corrosion products are removed from the various areas of the gas turbine blade 20, such as the airfoil 22 and the bottom surface 32 of the platform 28, as well as from other locations on the gas turbine blade 20. Any operable cleaning procedure may be used. One effective approach is to contact the turbine blade 20 to a weak acid bath, such as diammonium versene, and thereafter to grit blast the turbine blade 20. A light grit blasting is used on the airfoil 22, while the grit blasting of the bottom surface 32 of the platform 28 is usually heavier. During the cleaning, it is preferred not to remove any pre-existing protective coating from the surfaces of the airfoil 22, a process sometimes used in other repair contexts and known as "stripping" the coating.

Figure 3:
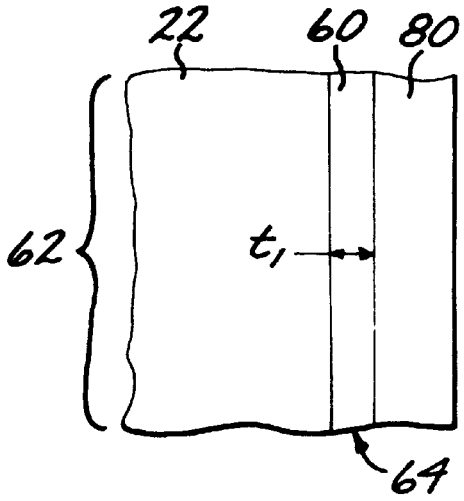
FIG. 3 is a schematic sectional view of the airfoil of the gas turbine blade, taken on line 3—3 of FIG. 1, but before the deposited layers are heated.
Figure 4:
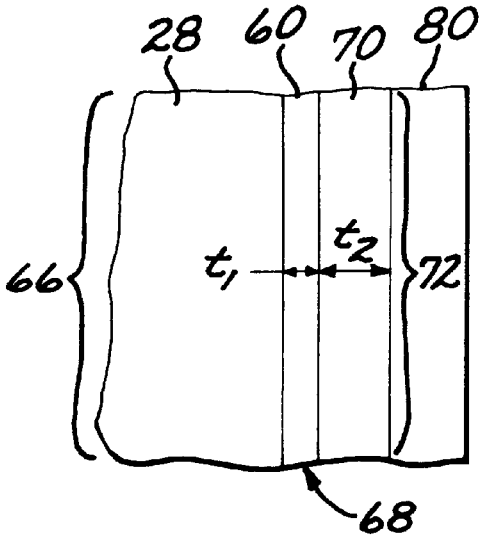
FIG. 4 is a schematic sectional view of the bottom side of the platform of the gas turbine blade, taken on line 4—4 of FIG. 1, but before the deposited layers are heated.

The method continues with first depositing, step 44, of a precious-metal first layer 60 on at least an airfoil first-layer region 62 of the airfoil 22 to form an airfoil portion 64 of the first layer, and on at least a platform first-layer region 66 of the bottom surface 32 of the platform 28 to form a platform portion 68 of the first layer, as seen in FIGS. 3 and 4. In the usual case, the airfoil first-layer region 62 includes only portions of the surface of the airfoil 22, such as the pressure side and the leading edge. The precious-metal first layer 60 is usually not applied to the trailing edge of the airfoil. The precious-metal first layer 60 is not applied to the surface of the dovetail 26. FIGS. 3 and 4 illustrate the layers that are respectively deposited upon the airfoil first-layer region 62 and upon the platform first-layer region 66. The same first layers 60 are deposited upon these regions 62 and 66, but the subsequent layers are different.

The precious metal that is deposited in the first deposition step 44 is any operable precious metal such as platinum, palladium, and/or rhodium (or their alloys with each other or with other metals). (As used herein, the naming of a metal includes both the relatively pure metal and also alloys of the metal.) Platinum is the preferred metal deposited in the first deposition step 44. The platinum-containing layer is preferably deposited by electrodeposition. For the preferred platinum deposition, the deposition is accomplished by placing a platinum-containing solution into a deposition tank and depositing platinum from the solution onto the surface of the substrate. An operable platinum-containing aqueous solution is $Pt(NH_3)_4HPO_4$, having a concentration of about 4–20 grams per liter of platinum, and the voltage/current source is operated at about ½–10 amperes per square foot of facing article surface. The precious-metal first layer 60 is deposited in 1–4 hours at a temperature of 190–200° F. Prior to this electrodeposition or other deposition technique, the surfaces that are not to have platinum deposited thereon are first masked to prevent deposition, as with masking tape, wax, or a rubber boot.

The precious-metal (platinum) first layer 60 is preferably deposited to a thickness $t_1$ of from about 0.00008 to about 0.000125 inches. If the thickness $t_1$ of the precious-metal first layer 60 is less than about 0.00008 inches, there is a substantial likelihood of incomplete coverage and there is also insufficient protection afforded by the subsequently formed platinum aluminide protective coating, as to the surfaces of the airfoil 22. If the thickness $t_1$ is greater than about 0.000125 inches, the final platinum aluminide protective coating is too thick and will crack under normal operating conditions. There is no substantial improvement in the protection afforded on the surfaces of the airfoil 22 by the overly thick platinum aluminide protective coating, and overall performance is degraded due to the cracking. Additionally, the expensive precious metal is wasted.

The method further includes a second depositing, step 46, of a precious-metal second layer 70 overlying at least part of the platform portion 68 of the first layer to form a platform portion 72 of the second layer, but not overlying the airfoil portion 64 of the first layer. That is, as shown in FIG. 4 the platform portion 72 of the second layer 70 is applied overlying the platform portion 68 of the first layer 60 on the platform 28, but not on the airfoil 22. The result is that the total thickness of the precious metal on the bottom side 32 of the platform 28 is greater than the total thickness of the precious metal on the airfoil 22. The greater thickness on the platform 28 is required because the platform 28 initially had no protective coating thereon, while the airfoil 22 had such a protective coating. The second depositing step 46 may be accomplished as a separate step from the first depositing step 44, or it may be accomplished by continuing the first depositing step on the bottom surface 32 of the platform 28 while discontinuing the deposition on the airfoil 22. Equivalently, the deposition may be accomplished by performing the complete deposition on the airfoil 22 and separately performing the complete deposition on the bottom surface 32 of the platform 28. The end result in all cases is to have a thicker layer on the bottom surface 32 than on the airfoil 22.

The precious metal that is deposited in the second deposition step 46 is any operable precious metal such as platinum, palladium, and/or rhodium, or their alloys, but is preferably the same metal as deposited in the first deposition step 44. Platinum is therefore the preferred metal deposited in the second deposition step 46. The platinum is preferably deposited by electrodeposition in the manner described above for the first deposition step 44. Prior to this electrodeposition or other deposition technique, the surfaces that are not to have platinum deposited thereon, including the airfoil first layer region 62 as well as the other regions such as the surfaces of the dovetail 26, are second masked to prevent deposition in the manner described above.

The precious-metal (platinum) second layer 70 is preferably deposited to a thickness $t_2$ such that the total thickness $t_1+t_2$ of the precious-metal first layer 60 and the precious-metal second layer 70 on the bottom side 32 of the platform 28 is from about 0.00018 to about 0.00032 inches. If the thickness $t_1+t_2$ of the precious-metal first layer 60 and the precious-metal second layer 70 is less than about 0.00018 inches on the bottom side 32 of the platform 28, there is a substantial likelihood of insufficient protection afforded by the subsequently formed platinum aluminide protective coating. If the total thickness $t_1+t_2$ is greater than about 0.000125 inches, the excessive amount of the precious metal may create a single-phase platinum coating which offers reduced protection.

A precious metal-aluminide protective coating is formed, step 48, by third depositing, step 50, preferably by vapor deposition, an aluminum-containing layer 80 overlying at least the airfoil portion 64 of the first layer 60 and the platform portion 72 of the second layer 70, and heating the gas turbine blade, step 52, to interdiffuse the deposited aluminum and the deposited precious metal, which is preferably platinum. The steps 50 and 52 are preferably performed at least in part concurrently in the preferred vapor phase aluminiding deposition procedure described subsequently.

Vapor phase aluminiding is a known procedure in the art, and any form of vapor phase aluminiding may be used. In its preferred form, baskets of chromium-aluminum alloy pellets are positioned within about 1 inch of the gas turbine blade to be vapor-phase aluminided, in a retort. The retort containing the baskets and the turbine blade 20 (typically many turbine blades are processed together) is heated in an argon atmosphere at a heating rate of about 50° F. per minute to a temperature of about 1975° F.+/−25° F., held at that temperature for about 3 hours +/−15 minutes, during which time aluminum is deposited, and then slow cooled to about 250° F. and thence to room temperature. These times and temperatures may be varied to alter the thickness of the aluminum-containing layer 80.

Because the gas turbine blade 20 and its deposited layers 60, 70, and 80 are heated during the third deposition 50, the layers 60, 70, and 80 interdiffuse to form an interdiffused airfoil platinum aluminide protective coating 90 over the airfoil first layer region 62, and a platform interdiffused platinum aluminide protective layer 92 over the platinum first layer region 66. These interdiffused protective layers 90 and 92 are shown respectively in FIGS. 5 and 6. The layers 60, 70, and 80 are no longer recognizable as distinct layers, and are interdiffused with each other. There may be and usually is additional heating 52, at a temperature of about 1925° F.+/−25° F. and for a time of about 30 to 45 minutes to further interdiffuse the layers 60, 70, and 80, either during the repair operation, during subsequent service, or both.

After the heating step 52, the airfoil precious-metal aluminide protective coating 90 is preferably about 0.001 inch greater than an airfoil precious-metal aluminide coating thickness at a conclusion of the step of cleaning (that is, prior to the steps 44, 46, and 48), and is preferably from about 0.0007 to about 0.0013 inches in thickness. The platform interdiffused precious-metal aluminide protective layer 92 is preferably about 0.0025 inch greater than a platform precious-metal aluminide coating thickness at a conclusion of the step of cleaning, and is preferably from about 0.0017 to about 0.0033 inches in thickness. In the usual case where there is no platform precious-metal aluminum coating at the conclusion of the step of cleaning, and the bottom surface 32 is bare metal, the total thickness of the precious-metal aluminum protective coating on the bottom surface 32 of the platform 28 is about 0.0025 inch. The thickness of the platform interdiffused precious-metal aluminide protective layer 92 may be greater than or lesser than that of the interdiffused airfoil precious-metal aluminide protective coating 90.

Figure 5:
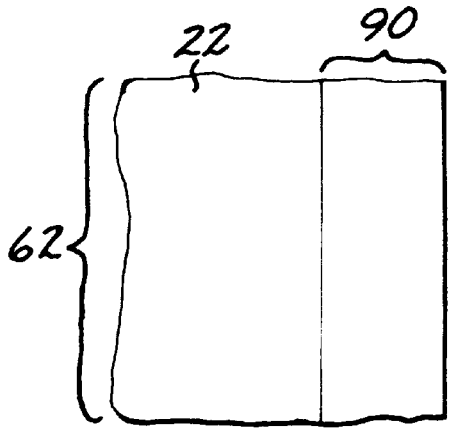
FIG. 5 is a view like that of FIG. 3, after heating the deposited layers.
Figure 6:
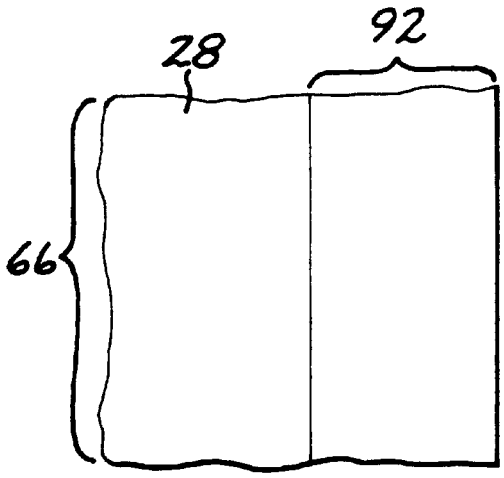
FIG. 6 is a view like that of FIG. 4, after heating the deposited layers.

The present approach has been reduced to practice using the approach of FIGS. 1 and 2 to produce protective coatings 90 and 92 such as described herein and illustrated respectively in FIGS. 5–6. The addition of the underplatform coating may improve the corrosion resistance of the surface by up to three times, as compared to that of the original bare surface. The described repair procedure has been demonstrated to show no reduction in the mechanical high cycle fatigue capability of the blade as compared with that prior to repair.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for protecting a gas turbine blade which has previously been in service, comprising the steps of providing the gas turbine blade which has previously been in service, the gas turbine blade having an airfoil, a dovetail, and a platform therebetween having a top surface and a bottom surface;

cleaning the gas turbine blade;

first depositing a precious-metal first layer on at least an airfoil first-layer region of the airfoil to form an airfoil portion of the first layer, and at least a platform first-layer region of the platform to form a platform portion of the first layer;

second depositing a precious metal second layer overlying at least part of the platform portion of the first layer to form a platform portion of the second layer, but not overlying the airfoil portion of the first layer;

third depositing an aluminum-containing layer overlying at least the airfoil portion of the first layer and the platform portion of the second layer; and heating the gas turbine blade to interdiffuse the aluminum and the precious metal.

2. The method of claim 1, wherein the step of providing includes the step of providing the gas turbine blade having no protective coating on the bottom surface of the platform.

3. The method of claim 1, wherein the step of cleaning includes the steps of removing surface dirt, oxides, and corrosion products from the airfoil, and removing surface dirt, oxides, and corrosion products from the platform.

4. The method of claim 1, wherein the step of cleaning includes the step of contacting the turbine blade to a weak acid bath, and thereafter grit blasting the turbine blade.

5. The method of claim 1, wherein the step of first depositing includes the step of first-depositing the precious-metal first layer by electrodeposition.

6. The method of claim 1, wherein the step of first depositing includes the step of first masking surfaces that are not to have the precious-metal first layer deposited thereon.

7. The method of claim 1, wherein the step of first depositing includes the step of first depositing platinum as the precious-metal first layer.

8. The method of claim 1, wherein the step of first depositing includes the step of first depositing the precious-metal first layer to a thickness of from about 0.00008 to about 0.000125 inches.

9. The method of claim 1, wherein the step of second depositing includes the step of second-depositing the precious-metal second layer by electrodeposition.

10. The method of claim 1, wherein the step of second depositing includes the step of second masking surfaces that are not to have the precious-metal second layer deposited thereon.

11. The method of claim 1, wherein the step of second depositing includes the step of second depositing platinum as the precious-metal second layer.

12. The method of claim 1, wherein the step of second depositing includes the step of second depositing the precious-metal second layer so that a total thickness of the precious-metal first layer and the precious-metal second layer is from about 0.00018 to about 0.00032 inches.

13. The method of claim 1, wherein the step of third depositing includes the step of third depositing the aluminum-containing layer by vapor phase deposition.

14. The method of claim 1, wherein the step of third depositing and the step of heating are performed at least in part concurrently.

15. The method of claim 1, wherein an airfoil precious-metal aluminide coating thickness on the airfoil at a conclusion of the step of heating is about 0.001 inch greater than an airfoil precious-metal aluminide coating thickness at a conclusion of the step of cleaning.

16. The method of claim 1, wherein a platform precious-metal aluminide coating thickness on the platform at a conclusion of the step of heating is about 0.0025 inch greater than a platform precious-metal aluminide coating thickness at a conclusion of the step of cleaning.

17. A method for protecting a gas turbine blade which has previously been in service, comprising the steps of providing the gas turbine blade which has previously been in service, the gas turbine blade having an airfoil, a dovetail, and a platform therebetween having a top surface and a bottom surface, wherein the platform has no protective coating on the bottom surface of the platform;

cleaning the gas turbine blade;

first depositing a platinum first layer on at least an airfoil first-layer region of the airfoil to form an airfoil portion of the first layer, and at least a platform first-layer region of the platform to form a platform portion of the first layer;

second depositing a platinum second layer overlying at least part of the platform portion of the first layer to form a platform portion of the second layer, but not overlying the airfoil portion of the first layer;

forming a platinum aluminide protective coating by third depositing by vapor deposition an aluminum-containing layer overlying at least the airfoil portion of the first layer and the platform portion of the second layer, and simultaneously heating the gas turbine blade to interdiffuse the aluminum and the platinum.

18. The method of claim 17, wherein the step of first depositing includes the step of first depositing the platinum first layer to a thickness of from about 0.00008 to about 0.000125 inches.

19. The method of claim 17, wherein the step of second depositing includes the step of second depositing the platinum second layer so that a total thickness of the platinum first layer and the platinum second layer is from about 0.00018 to about 0.00032 inches.

20. The method of claim 17, wherein an airfoil platinum aluminide coating thickness on the airfoil at a conclusion of the step of heating is about 0.001 inch greater than an airfoil platinum aluminide coating thickness at a conclusion of the step of cleaning.

21. The method of claim 17, wherein a platform platinum aluminide coating thickness on the platform at a conclusion of the step of heating is about 0.0025 inch greater than a platform platinum aluminide coating thickness at a conclusion of the step of cleaning.

22. A method for protecting a gas turbine blade which has previously been in service, comprising the steps of providing the gas turbine blade which has previously been in service, the gas turbine blade having an airfoil, a dovetail, and a platform therebetween having a top surface and a bottom surface;

cleaning the gas turbine blade;

depositing a precious-metal first layer on an airfoil first-layer region of the airfoil;

depositing a precious metal second layer on at least part of the platform, wherein the precious-metal second layer is thicker than the precious-metal first layer;

depositing an aluminum-containing layer overlying at least the precious-metal first layer and the precious-metal second layer; and heating the gas turbine blade to interdiffuse the aluminum and the precious metal.

* * * * *

UNITED STATES PATENT AND TRADEMARK OFFICE

CERTIFICATE OF CORRECTION

PATENT NO. : 6,652,914 B1 
DATED : November 25, 2003
INVENTOR(S) : Nigel Brian Thomas Langley et al.

It is certified that error appears in the above-identified patent and that said Letters Patent is hereby corrected as shown below:

Title page,
Item [74], *Attorney, Agent or Firm*, "Gergory Garmong" should read -- Gregory Garmong --.

Signed and Sealed this

Twenty-third Day of March, 2004

JON W. DUDAS
*Acting Director of the United States Patent and Trademark Office*